United States Patent [19]

Martin

[11] Patent Number: 5,038,589

[45] Date of Patent: Aug. 13, 1991

[54] REKEYABLE CAM LOCK

[75] Inventor: Frank J. Martin, Seattle, Wash.

[73] Assignee: Frank J. Martin Company, Seattle, Wash.

[21] Appl. No.: 527,133

[22] Filed: May 22, 1990

[51] Int. Cl.[5] ..... E05B 27/04

[52] U.S. Cl. ..... 70/368; 70/375

[58] Field of Search ..... 70/367-369, 70/370, 371, 375, 382, 385

[56] References Cited

U.S. PATENT DOCUMENTS

| | | | |
|---|---|---|---|
| 587,564 | 8/1897 | Voight | 70/375 |
| 1,414,348 | 5/1922 | Falk | 70/375 |
| 1,699,757 | 1/1929 | Segal | 70/367 |
| 1,835,725 | 12/1931 | Thompson et al. . | |
| 1,990,934 | 2/1935 | Falk | 70/46 |
| 2,014,233 | 9/1935 | Keil | 70/375 |
| 2,049,742 | 8/1936 | Lowe | 70/369 |
| 2,430.391 | 11/1947 | Dequick | 70/368 |
| 2,877,638 | 3/1959 | Muttart | 70/224 |
| 2,922,298 | 1/1960 | Wiener | 70/367 |
| 3.263,461 | 8/1966 | Tartaglia | 70/383 |
| 3,399,555 | 9/1968 | Gray et al. | 70/369 |
| 3,429,154 | 2/1969 | Schwartz | 70/375 |
| 3,434,316 | 3/1969 | Neary | 70/369 |
| 3,793,857 | 2/1974 | Schlage | 70/368 |
| 3,863,476 | 2/1975 | Patriquin | 70/419 |
| 4,099,397 | 7/1978 | Dauenbaugh | 70/371 |
| 4,228,668 | 10/1980 | Scherbing | 70/375 X |

FOREIGN PATENT DOCUMENTS

| | | | |
|---|---|---|---|
| 67305 | 7/1948 | Denmark . | |
| 814411 | 12/1951 | Fed. Rep. of Germany . | |
| 3406554 | 8/1985 | Fed. Rep. of Germany . | |
| 1218041 | 1/1971 | United Kingdom | 70/370 |

*Primary Examiner*—Lloyd A. Gall

*Attorney, Agent, or Firm*—Michael J. Folise

[57] ABSTRACT

A rekeyable cam lock has a plug rotatably received in a cylinder. The plug has a keyway and pin tumblers and is provided with a circumferential groove rearward of the pin tumbler. The cylinder has a bore to receive the plug and a pair of transverse holes to receive a U-shaped clip in registration with the plug groove. The clip engages the groove, permitting rotation of the plug but preventing its removal from the cylinder. When the clip is removed from the holes, the plug is forwardly removable from the cylinder to facilitate rekeying of the lock.

5 Claims, 1 Drawing Sheet

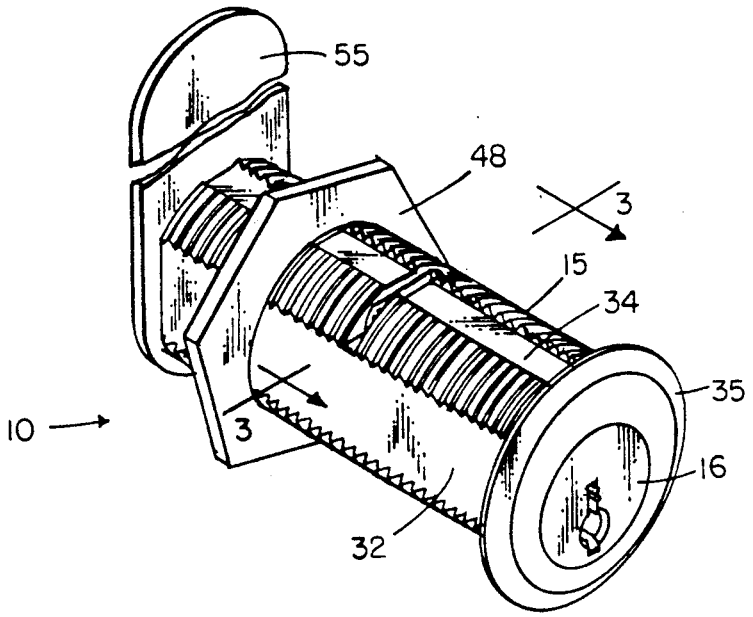
FIG.1
FIG.3
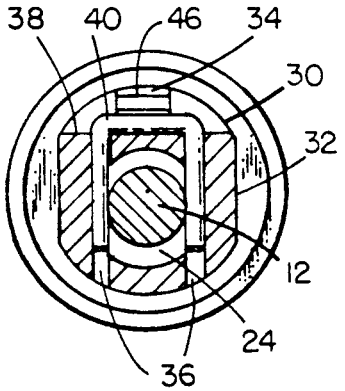
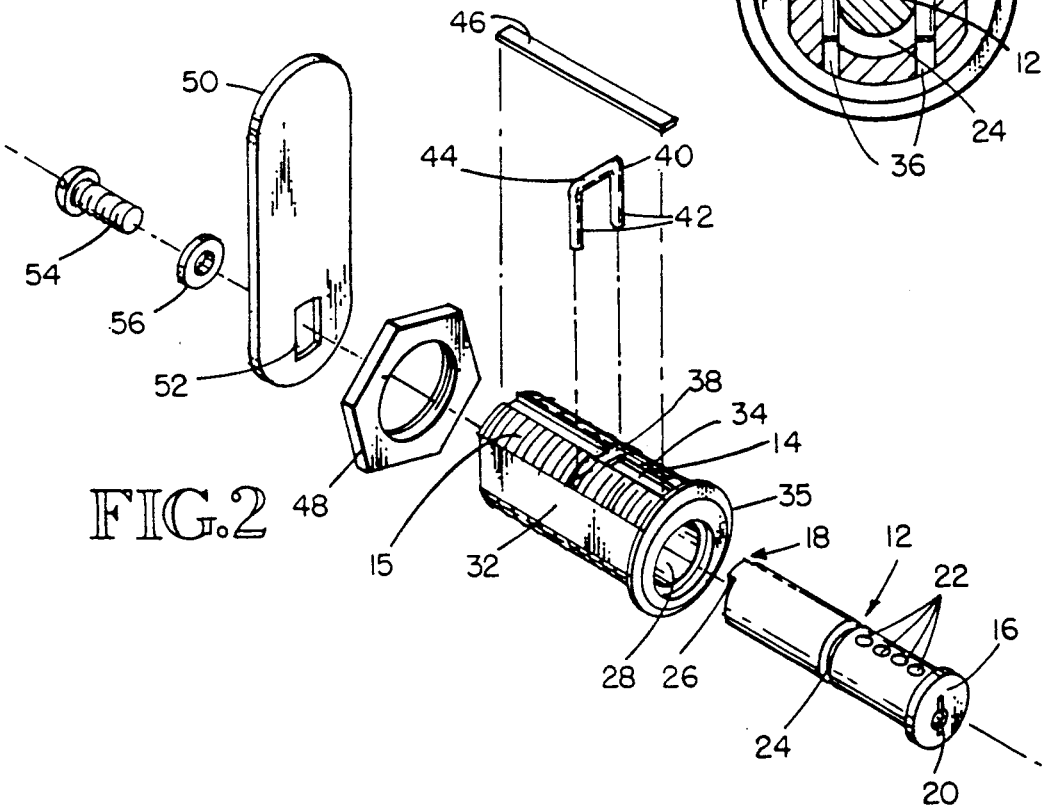
FIG.2

REKEYABLE CAM LOCK

DESCRIPTION

1. Technical Field

The invention relates to security devices for cabinet drawers and doors. More specifically, the invention relates to rekeyable pin tumbler cam locks.

2. Background of the Invention

Pin tumbler drawer and cabinet locks are often rekeyed to provide security and key control. Rekeying requires disassembly of the lock. A cam lock is one type of cabinet drawer/door lock which has a bolt (or "cam") which rotates about a rotation axis passing through one end of the cam (rather than oscillating as a piston). The cam is typically directly connected to a rotating plug through the rotation axis such as by a screw. Cam locks therefore can not use disassembly techniques or devices which interfere with the swinging action of the cam at the rear of the lock. Oscillating bolt action locks having forwardly removable cylinder and plug assemblies for easy rekeying are known. However, this type of rekeyability is unknown in presently available cam locks.

Complex assemblies and parts which are difficult or expensive to manufacture are generally undesirable in the lock art. Simple assemblies generally permit reduced manufacturing costs, improved reliability, and serviceability in the field. In addition, locks which require special tools to facilitate disassembly for rekeying have been historically disfavored by locksmiths.

U.S. Pat. No. 3,263,461, to Tartaglia, describes a rekeyable cam lock. However, the lock is not a standard pin tumbler type but employs an uncommon tumbler which requires a nonstandard key. The plug is not removable from the front of the lock and can only be removed from the rear of the lock after substantial disassembly. The lock is partially disassembled with a special change key which accesses the lock via the keyway.

U.S. Pat. No. 3,429,154, to Schwartz, and U.S. Pat. No. 2,877,638, to Muttart, each describe a rekeyable pin tumbler lock having a plug retaining clip at the rear of the lock. The rearward clip configuration prohibits the use of the Schwartz and Muttart designs as cam locks, because the plug retaining clip would interfere with the installation and operation of a cam. The clip on each lock is fixed to and rotates with its plug, requiring a complex plug shape to be engaged by the clip. Each clip will be periodically inverted when the lock is activated. Therefore, a complex snap-on shape is required to prevent the clip from falling off the plug.

U.S. Pat. No. 3,863,476, to Patriquin, and U.S. Pat. No. 1,990,934, to Falk, both describe rekeyable cam locks having plugs retained by integrated spring clips. Each lock has a spring clip that resides in the plug and is disposed to ride in an interior circumferential groove in the plug bore of the cylinder. The clip prevents removal of the plug unless the clip is actuated with a special tool. The provision of an interior groove and a spring activated clip lead to increased manufacturing costs and complexity. In addition, a failure of the spring which acts on the clip may cause the plug to fall out.

U.S. Pat. No. 2,922,298, to Wiener, describes a rekeyable lock. Weiner's lock is provided with a plug having a circumferential groove. The circumferential groove is engaged by an eccentric ring which contains the plug in the lock body. A large housing and a complex mechanism are used to center the ring about the plug's axis to permit removal of the plug for rekeying. This lock is not suitable where compact and robust locks are desired.

Therefore, there is a need for a rekeyable cam lock which may be affordably manufactured and easily serviced without specialized tools. Such a lock should be compact to permit installation where space is at a premium.

SUMMARY OF THE INVENTION

It is an object of the present invention to provide a cam lock which can be easily rekeyed without specialized tools.

It is also an object of the present invention to achieve the above object in a lock that may be inexpensively manufactured.

It is yet another object of the present invention to achieve the above two objects in a compact assembly.

The invention achieves these advantages, and other objects and advantages which will become apparent from the description which follows, by providing a rekeyable cam lock for cabinet doors and drawers, having a lock plug with a plurality of pin tumblers and a circumferential groove about its exterior. The lock also has an elongated cylinder with a bore for rotatably receiving the plug. A removable device is used to releasably retain the plug within the cylinder. No special tools are required to release the plug.

In the preferred embodiment, the cylinder has a slot into which a simple clip is inserted to engage the circumferential groove of the plug. The clip releasably retains the plug in the cylinder. To remove the plug for rekeying, a locksmith merely removes the clip. The clip is preferably U-shaped, with two substantially parallel prongs connected by a cross bar. The slot consists of two parallel bores sized to receive the clip and positioned to register with the circumferential groove.

BRIEF DESCRIPTION OF THE DRAWINGS

FIG. 1 is an isometric view of a lock employing the concept of the present invention.

FIG. 2 is an exploded isometric view of the lock.

FIG. 3 is a front elevational, sectional view of the lock showing the plug retaining mechanism.

DETAILED DESCRIPTION OF THE INVENTION

A rekeyable pin tumbler cam lock employing the concept of the present invention is generally indicated at reference numeral 10 in FIG. 1, and is further illustrated in FIGS. 2 and 3.

As shown in FIG. 2, the lock includes a plug 12 which is axially and rotatably received in an elongated cylinder 14. The cylinder has a threaded exterior surface 15 throughout substantially its entire length. The plug is also cylindrical and has a substantially constant cross sectional diameter. The plug has an enlarged diameter front end 16, which prevents the plug from receding too far into the cylinder 14. The plug also has a rear end diameter 18.

The plug 12 is provided with a keyway 20 which penetrates the plug longitudinally from the front end 16 for receiving a key (not shown). The plug has a plurality of pin tumblers 22 located along the keyway and generally toward the front end 16 of the plug. The plug is provided with a circumferential groove 24 located rearward of the pin tumblers. The groove encircles the exterior of the plug and has a depth substantially less than the radius of the plug. The rear end 18 of the plug is provided with an oblong nose 26 and a threaded hole (not shown) for mounting a bolt or cam 50 so that the cam rotates with the plug. The threaded hole is concentric with the plug's axis.

The cylinder 14 has an off-center, longitudinal bore 28 which is sized to rotatably receive the plug 12. The cylinder may also be provided with flat sides 32 to prevent the lock from rotating when installed in an oblong hole, such as in a drawer or door. The cylinder has a lid channel 34 longitudinally formed along its top surface, providing a recessed rectangular area along the cylinder's length. The enlarged diameter front end 16 of the cylinder 14 has a flange 35 which cooperates with a threaded nut 48 to fix the lock axially with respect to cabinet or door or drawer.

As best seen in FIG. 3, the cylinder 14 is provided with two spaced-apart bores 36 which are drilled perpendicular to the cylinder's axis and located axially along the cylinder's length so as to register with the circumferential groove 24 of the fully-installed plug 12. The spaced-apart bores have diameters approximately equal to the depth of the circumferential groove 24, and are separated by a distance generally equal to the narrowed diameter of the plug 12 at the circumferential groove. The cylinder is also provided with a clearance slot 38 perpendicular to the axis of the cylinder. The clearance slot joins the bores 36 and is transverse to the direction of the bores. The clearance slot is located in the same plane as the spaced-apart bores, and cut into the top surface of the cylinder to a depth greater than the depth of the lid channel 34.

The lock is provided with a U-shaped clip 40 which releasably retains the plug 12 within the longitudinal bore 28. The clip has two parallel, spaced-apart prongs 42 which have a diameter slightly less than that of the spaced-apart bores 36 and are sufficiently spaced-apart to be received within the spaced-apart bores. The prongs are downwardly projecting from and are connected at their top ends by a cross member 44. The cross member is contained within the clearance slot 38 and is sized so that it does not protrude beyond the threaded exterior surface 30 of the cylinder or penetrate the lid channel 34. When the plug 12 is fully installed in the longitudinal bore 28 the prongs are tangentially disposed with respect to the circumferential groove 24.

The cylinder 14 of the lock 10 is provided with a rectangular lid 46. The lid is sized to fit entirely within the lid channel 34 so that the lid does not protrude beyond the threaded exterior surface 30 of the cylinder. The lid prevents the pin tumblers from falling out of the lock after it has been rekeyed. As previously stated, the lock is provided with a retaining nut 48 which is threaded to cooperate with the threaded exterior surface 30 of the cylinder 14. By recessing the lid 46 below the level of the threads 30, the lid does not interfere with the operation of the retaining nut.

As previously stated and as shown in FIG. 2, the lock 10 is provided with a cam 50. The cam has an oblong hole 52 sized to receive the oblong nose 26 of the plug 12. A screw 54 is sized to pass through a washer 56 and through the oblong nose 52 of the cam, so as to threadably engage the threaded hole (not shown) in the rear end 18 of the plug 12. Thus, the cam 50 is journaled for rotation with the plug.

The lock is mounted to a drawer or door panel having an oblong hole with a diameter on its curved surface which is slightly larger than the diameter of the threaded exterior surface 30. The cylinder is inserted in the panel hole until the front end flange 35 contacts the panel's front surface. The retaining nut 48 is installed and tightened to compress the panel between the nut and the front end flange. The cam 50 is installed after the cylinder is mounted in the panel.

Disassembly to permit rekeying is accomplished by: removing the cam 50 from the plug 12; removing the lock from the panel; removing the top pin cover 46 from the channel 34; lifting out the clip 40 with any small pointed tool; and sliding out the plug. To prevent the loss of the upper pin tumblers contained within the cylinder, a follower tool having the same diameter as the plug is inserted in the rear of the bore to push out the plug and retain the upper pin tumblers. To complete rekeying of the lock, the pin tumblers 22 are replaced and the above procedure is reversed.

Other variations and embodiments of the invention are contemplated. For example, the shape of the cam 50 may be modified to accommodate different types of installations. The configuration of the clip 40 may be changed, for instance, to that of a pin with a single prong. Therefore, the invention is not to be limited by the above description but is to be defined in scope by the following claims.

I claim:

1. A rekeyable cam lock for cabinet doors and drawers, comprising:

a cylindrical plug having a keyway, a plurality of pin tumblers in communication with the keyway, and an exterior, circumferential groove located rearwardly of the pin tumblers;

an elongated cylinder having an off-center, longitudinal bore therein for rotatably receiving the plug, the elongated cylinder also having two transverse, spaced-apart bores therein positioned to register with the circumferential groove when the plug is received by the elongated cylinder, the elongated cylinder also having an external slot joining the bores; and a U-shaped clip sized to be removably received in the bores and the slot so as to removably retain the plug within the elongated cylinder, the clip having dimensions selected so that the clip does not protrude from the external slot.

2. The cam lock of claim 1 wherein the elongated cylinder has a threaded exterior and is provided with a longitudinal lid channel which is located along the length of the elongated cylinder and positioned directly above the clip, when the clip is received in the bores and the external slot, and wherein the elongated cylinder is provided with a removable lid which is received within the lid channel and sized not to protrude beyond the threaded surface of the elongated cylinder so that a retaining nut can be threaded on the cylinder substantially throughout the cylinder length.

3. The cam lock of claim 2 wherein the external slot is formed substantially perpendicular to the axis of the elongated cylinder and cut to a depth sufficient to permit the U-shaped clip to be seated in the external slot without the clip protruding into the lid channel so that the clip may reside below the removeable lid and be retained thereby.

4. A rekeyable cam lock for installation in a drawer or door panel, comprising:

a cylindrical plug having a circumferential groove;

an elongated cylinder defining a longitudinal bore sized to rotatably and removably receive the cylindrical plug, wherein the elongated cylinder also defines two apertures positioned to register with the circumferential groove when the plug is fully inserted into the bore; and a substantially U-shaped clip having two substantially parallel, spaced-apart prongs joined together by a transverse bar for releasably engaging the elongated cylinder with the circumferential groove, wherein the transverse bar has a length slightly less than the diameter of the circumferential groove, so that there is an interference fit between the prongs of the clip and groove thereby restraining the cylindrical plug from axial motion within the longitudinal bore while permitting rotation of the plug within the bore.

5. The cam lock of claim 4 wherein the prongs and the transverse bar of the clip have dimensions smaller than the depth of the groove to prevent the clip from protruding beyond the surface of the elongated cylinder.

* * * * *